United States Patent [19]

Wilson

[11] Patent Number: 4,894,874

[45] Date of Patent: Jan. 23, 1990

[54] AUTOMATIC FAUCET

[75] Inventor: John R. Wilson, Naperville, Ill.

[73] Assignee: Sloan Valve Company, Franklin Park, Ill.

[21] Appl. No.: 173,883

[22] Filed: Mar. 28, 1988

[51] Int. Cl.[4] ..... E03C 1/05

[52] U.S. Cl. ..... 4/623; 251/129.04

[58] Field of Search ..... 4/623, DIG. 3; 251/129.03, 129.04, 129.05; 250/221; 340/556

[56] References Cited

U.S. PATENT DOCUMENTS

| | | | |
|---|---|---|---|
| 3,480,787 | 11/1969 | Johansen | 4/623 |
| 4,402,095 | 9/1983 | Pepper | 4/623 |
| 4,520,516 | 6/1985 | Parsons | 4/623 |
| 4,688,277 | 8/1987 | Kakinoki et al. | 4/623 |
| 4,722,372 | 2/1988 | Hoffman et al. | 4/623 |
| 4,762,273 | 8/1988 | Gregory et al. | 4/623 |
| 4,767,922 | 8/1988 | Stauffer | 250/221 |

*Primary Examiner*—Henry J. Recla
*Assistant Examiner*—J. Casimer Jacyna
*Attorney, Agent, or Firm*—Kinzer, Plyer, Dorn, McEachran & Jambor

[57] ABSTRACT

A faucet for automatic operation defining a base and an elongated cantilevered spout body provided with a discharge outlet. A sensing means for automatic operation in the form of an emitter an detector are mounted on the spout body intermediate the base and discharge outlet. The emitter and detector are positioned on the longitudinal center of the spout body and provide a concentrated zone of effective detection disposed intermediate the area of discharge from the faucet and the base. The zone shape is transversely elongated relative to the longitudinal center of the faucet spout body.

7 Claims, 2 Drawing Sheets

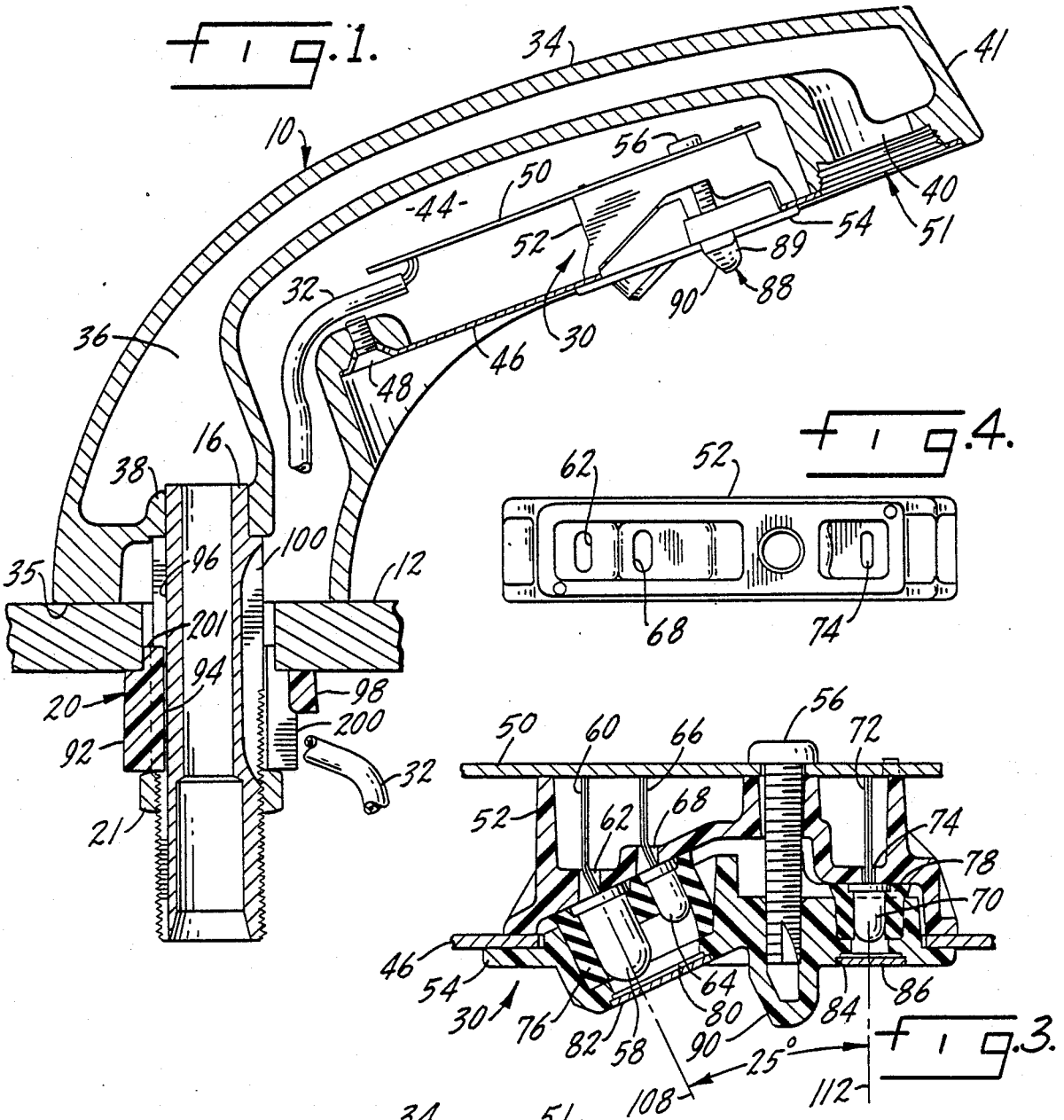
Fig. 1.
Fig. 4.
Fig. 3.
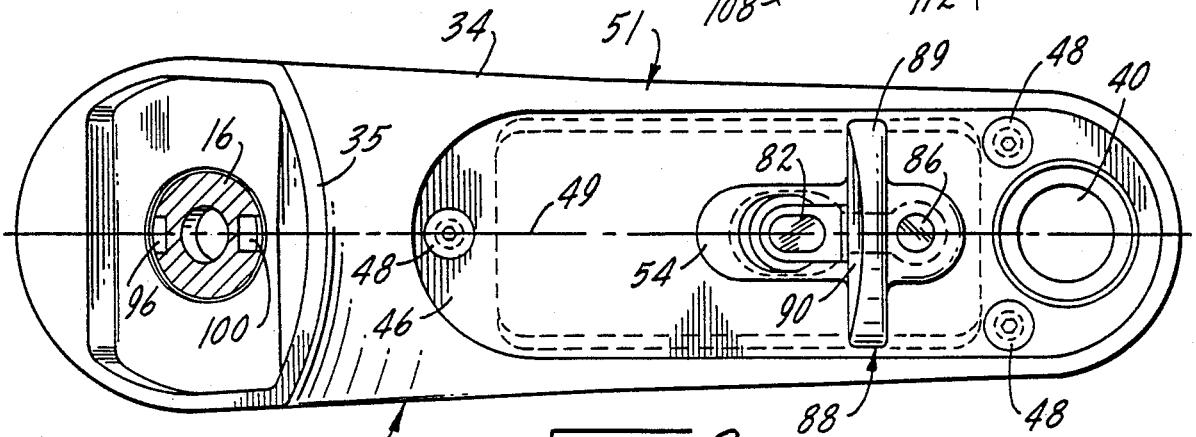
Fig. 2.

AUTOMATIC FAUCET

BACKGROUND OF THE INVENTION

This invention relates to an automatically-controlled water faucet of the type using automatic detection means for controlling the water supply from the faucet. One of the difficulties with this type of faucet is designing it so it will respond to the presence or absence of a user but will not respond to other objects or activity, such as reflection from the sink basin, the water flow, or other extraneous signals. The design problems are further complicated by the desire to make the control reasonably sensitive to a user's presence at an operative position essentially beneath the faucet outlet.

Faucets having associated emitting and/or detecting means mounted to detect a user's presence are shown in U.S. Pat. Nos. 3,151,340; 3,415,278; 3,491,381; 3,505,692; 3,551,919; 3,585,652; 3,638,680; 4,398,310; 4,402095; 4,682,628; 4,604,764 and 4,709,728. None provide a concentrated zone of effective detection which is positioned optimally relative to the flow path from the faucet discharge.

SUMMARY OF THE INVENTION

The present invention is directed to a faucet arranged for automatic operation having a base to be mounted on a sink basin and arranged to discharge water into the basin when activated. It includes an elongated cantilevered spout body provided with a discharge outlet. An emitter is provided for transmitting signals into the area underneath the faucet. A detector is provided which receives signals reflected from a user in the area under the faucet to activate a circuit which generates a signal for opening and closing a valve in the water supply line.

The emitter and detector are mounted in the faucet body intermediate the base and discharge outlet along the longitudinal center of the spout body. The centerline of the detector field of view is parallel to the centerline of the faucet discharge outlet and slightly behind the outlet stream relative to a user standing at the sink. The centerline of the emitter output is at a convergent angle relative to the centerline of the detector field of view to intersect and form a concentrated zone of effective detection. The concentrated zone of effective detection has a shape wider than it is deep transverse relative to the longitudinal center of the faucet spout body. Preferably, the centerline of the emitter output is at an angle relative to a sink bottom such that signals reflected from the sink bottom bounce away from the detector field of view.

BRIEF DESCRIPTION OF THE DRAWINGS

FIG. 1 is a sectional through the faucet of the present invention.

FIG. 2 is an underside view of the faucet.

FIG. 3 is an enlarged sectional view of the electronic control apparatus.

FIG. 4 is a plan view of the optical base.

DETAILED DESCRIPTION OF THE INVENTION

Figure 5:
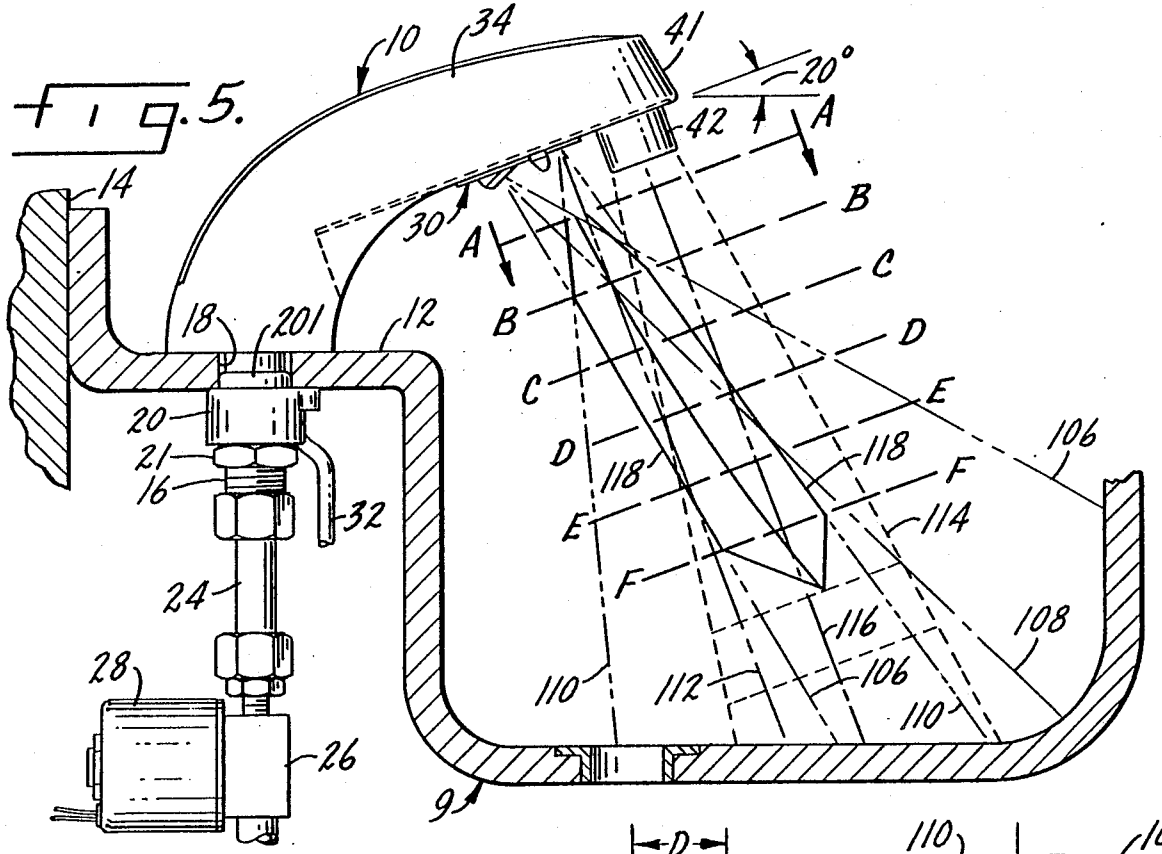
FIG. 5 is a side elevation view of a sink using the faucet of the present invention and showing the stream of water and the emitter output and detector field of view.

The overall construction of a faucet according to the present invention is best illustrated in FIG. 5. Sink basin 9 is attached to a wall 14 and includes a faucet generally designated 10 mounted on basin ledge 12. The faucet is connected to a shank 16 which extends through a port 18 in the ledge for securement from beneath the ledge as will be explained. The shank 16 is connected to a water supply line 24. The water supply line includes a valve 26 operable by solenoid 28. The water supply line is connected to a mixing valve (not shown) which mixes hot and cold water, which is fed to the supply line 24. Thus, the faucet of the illustrated embodiment discharges water having a pre-set temperature. Of course, the automatic operation aspect of the present invention could be utilized with any faucet including one having control of discharge temperatures.

Solenoid 28 is controlled by signals from an electronic control means indicated generally at 30. Electrical connections for the power supply and the control signals are provided through electrical cable 32. The cable is connected to the solenoid 28 and a power source (not shown).

Details of the faucet 10 and the electronic control means 30 are shown in FIGS. 1–4. The exposed portion of the faucet includes spout 34, with a base 35 resting on ledge 12. As seen in FIGS. 1, 2 and 5, spout body 34 is longitudinally elongate and is cantilevered from base 35, which rests upon basin ledge 12. Connection 38 mounts the upper end of the shank 16 to the spout 34. The spout body is longitudinally elongate from the base 35 to free end 41. For illustrative purposes, an imaginary vertical plane 49 bisects the longitudinal extent of the faucet body as shown in FIG. 2.

A water passage 36 extends from a connection 38 to a discharge outlet 40 adjacent free end 41. An aerator 42 (FIGS. 5 and 6) may be threaded into the discharge outlet.

The underside of the faucet spout body (facing basin 9) includes downwardly facing planar surface 51, which includes discharge outlet 40. The discharge outlet 40 is formed on centerline 116, and is generally perpendicular to surface 51.

Spout body 34 defines a cavity 44 in which electronic control means are mounted. Access to the cavity is through a cover plate 46 which is held to surface 51 in the faucet body by screws. The electronic control means 30 includes a printed circuit board 50 which carries the circuit required for generating the control signals to the solenoid 28 in response to the sensing of reflected signals. The circuit may be any suitable circuit. Examples of circuits which may be used to control the operation of the faucet include those disclosed in U.S. Pat. Nos. 4,309,781; 4,402,095 and 4,682,628. Another circuit suitable for use in the control of the faucet illustrated here is shown and described in application Ser. No. 157,606, filed Feb. 19, 1988, and assigned to the present assignee of this application. The particular circuitry forms no part of the present invention.

The sensing arrangement of the illustrated embodiment utilizes an infrared emitter and detector. Signals emitted from the signal emitter are reflected by a stimulus such as the hands of the user and are received by the signal detector. Appropriate circuitry is provided which operates the solenoid 28 in response to the reflected signals. It is contemplated that any emission and detection device could be substituted for the disclosed system.

The printed circuit board is connected to a base 52 and a cover 54 by a screw 56. The cover plate 46 is trapped between the base and cover, with the cover exposed through an opening in the cover plate.

The base 52 mounts an emitter 58. The emitter leads 60 extend through an opening 62 in the base to connect to the printed circuit board 50. In a preferred embodiment, the emitter is a gallium aluminum arsenide infrared emitting diode such as an OP295C available from Optaelectronics Divison of TRW, Electronic Component Group, Carrollton, Tex..

A detector 70 having leads 72 extends through openings 74 for connection to the printed circuit board 50. The detector 70 is an NPN silicon phototransistor such as an OP501SLA available from the same source. The emitter and detector are disposed on the longitudinal center of spout body 34 with the detector positioned nearest the discharge outlet.

A visible LED 64 is mounted adjacent to the emitter 58. Leads 66 extend through openings 68 for connection to the printed circuit board 50. The visible LED 64 is used for circuit diagnosis. It is connected electrically to glow dimly to indicate power is being supplied to the board. The LED 64 is also arranged to glow brightly when the control means receives infrared light signals reflected from a user's hands.

An elastomeric emitter seal 76 encompasses the emitter 58 and LED 64 and is pressed into contact with the base 52 by the cover 54 to prevent water from shorting the leads 60 and 66. Similarly, an elastomeric detector seal 78 encompasses the detector 70 and is pressed into engagement with the optical base 52 by the cover 54. An emitter opening 80 in the cover permits passage of light through the emitter window 82 (FIG. 2). Likewise, a detector opening 84 permits entry of light through the detector window 86.

Figure 6:
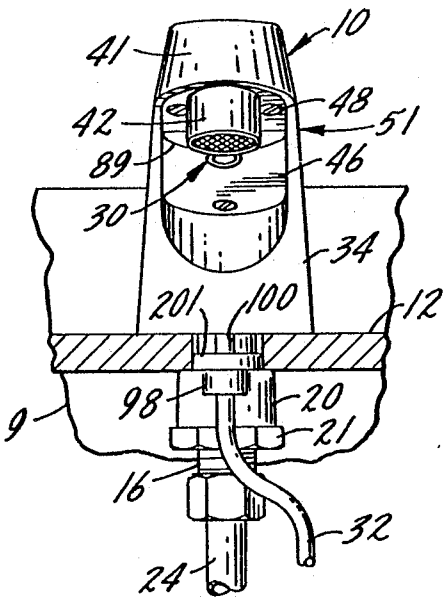
FIG. 6 is a front view of the faucet.

A drip guard 88 extends downwardly from the cover plate 46 and extends transversely of the spout body longitudinal center 49 between the emitter 58 and detector 70. As seen in FIGS. 2 and 6, the drip guard includes an arcuate surface 89 which causes any water to collect in droplets at the lowest portion of the surface and drop off the guard into the basin 9. The function of the guard 88 is to prevent a direct light path from the emitter 58 to the detector 70. Such a path could possibly be caused by water droplets or by stray light rays. The drip guard has an angled surface 90 so as to not interfere with the signals emanating from the emitter.

A spacer 20 and nut 21, illustrated in FIGS. 1, 5 and 6, secure the faucet to the basin body 12. Spacer 20 has a generally cylindrical body 92 having a central bore therethrough which allows the spacer to slip into the faucet shank 16, as best seen in FIG. 1. A key 94 on the interior of the body engages a keyway 96 in the faucet shank 16 to rotationally lock the spacer and shank together. One side of the spacer has a longitudinal slot 200 which is spanned by a cable guide loop 98. The slot 200 provides ready access to a slot 100 in the shank 16 for threading the cable 32 out of the faucet body cavity 44. A locating ring 201 on the upper surface of the spacer 20 fits in the port 18 of the basin to centralize the shank 16 with respect to the port.

Turning now to FIG. 5, the arrangement of the emitting and detecting is illustrated. The emitter 58 emits infrared light in a narrow output cone of emission emanating from planar surface 51. The cone of emission has an axis 108 and the general boundaries at the two-thirds power point are at about a 30° included angle as illustrated at 106. The detector 70 senses an area beneath the planar surface 51 for infrared light impinging on it from within a narrow conical field of view having an axis 112 and an included angle of about 30° at the two-thirds power point, defined by the general boundaries 110. The general envelope of the water stream is shown at 114.

Figure 7:
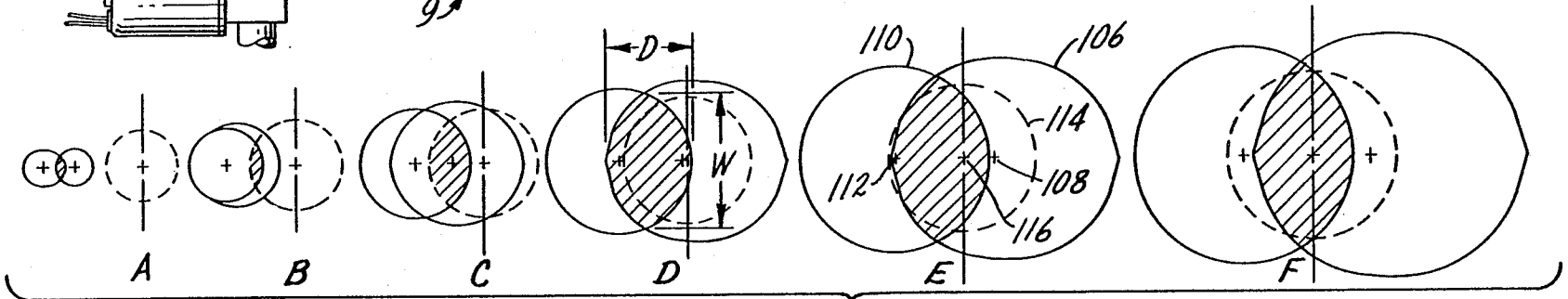
FIG. 7 is a series of schematic views of the interference pattern between the emitter output and detector field of view, as well as the water stream, taken along lines A-A through F—F in FIG. 5.

FIG. 7 shows the cross section of the intersections of the output cone of emission and field of view 110 at various distances from the emitter and detector. Cross sections A-A through F—F are located at one inch intervals.

The concentrated primary zone of detection is at the intersection between the cone of emitter output 58 and cone of field of view 110 of detector 70. In a sense, this can be thought of as an electronic handle or lever for actuating the faucet. Its boundaries are illustrated at 118 in FIG. 5. The zone is optimally disposed generally behind the water stream, yet near enough such that a user is properly positioned underneath the outlet upon commencement of flow.

It will be noted that there is a non-detection zone adjacent the faucet body 10. This feature helps in maintaining a cleaner faucet by keeping the user's hands away from the faucet. It also assists in reducing false triggering of the circuit. There is also a non-detection zone adjacent to the basin. This is required to avoid detection of the basin, regardless of shape, size and/or color. As seen in FIG. 7, the detection zone extends between sections A—A, which commences about one inch from planar surface 51 and F—F, which is about six inches from planar surface 51. The best detection occurs in that area as a result of a combination of the shortest distance from the emitter and detector, the large overlapping areas of emitter output and detector field of view, and the high intensity of the infrared light and sensitivity of the detection at these elevations.

It will be noted that the control means 30, which supports the emitter and detector is mounted in the cantilevered spout body 34. The downwardly facing planar surface 51 of the spout body extends at an angle of 20° to the horizontal. Because the output of the emitter does not impinge perpendicularly on the basin bottom, this effectively increases the distance between the emitter and detector and the bottom basin, which in turn reduces possible inadvertent detection of the basin. It will also be noted that the angle of the centerline 108 of the output cone of the emitter 58 is tilted 25° toward the centerline 112 of the cone of the field of view 110 of detector 70. The cones therefore converge to provide the intersections described and shown in FIGS. 5 and 7.

FIG. 7 illustrates that the intersections of the cones 106 and 110 defines an asymmetric shape. Looking at section D-D, the electronic lever has a width W and a depth D, with the width transverse to the center of the longitudinal extent of the faucet being greater than the depth. Thus, the zone of effective detection is wider than it is deep in reference to the position of the user standing in front of the outer or free end of the faucet. This allows easier detection by giving the user a wider target area. Also, the reduced depth is required to avoid detection of the water stream. The asymmetric cross section of the electronic lever results from placing the emitter and detector on the longitudinal center 49 of the faucet body and positioning the center lines of their respective operative cones of activity at a convergent angle relative to each other. The electronic lever is as close to the water stream as possible without triggering false readings from light being reflected off the water. Yet, a user can place his hands where he expects the water stream to be and activate the faucet.

The reason the electronic lever 118 attenuates after section F in FIG. 5 is the intensity of the infrared light has dissipated at that point to an extent that will not permit detection at the detector. As a result, the basin will not activate the control circuit.

Whereas a preferred form of the invention has been shown and described, it will be realized that changes may be made thereto without departing from the scope of the following claims.

What is claimed:

1. A faucet for automatic operation, defining a base and an elongated spout body extending therefrom including a discharge outlet spaced from the base, said spout body defining a generally planar surface disposed at about an angle of 20° to horizontal, sensing means operative to automatically operate said faucet by detecting the presence of a user comprising a signal emitter and a signal detector disposed intermediate said base and said outlet, said emitter and detector each being disposed on the longitudinal centerline of the spout body, and said emitter and detector and said discharge outlet each face outwardly from said planar surface, said detector having a field of view symmetrical about an axis, said axis being parallel to a centerline of said discharge outlet, said sensing means being able to communicate with a faucet control means adapted to automatically operate said faucet, and a drip guard disposed between said emitter and detector extending from said planar surface and being generally arcuate in a direction transverse to the longitudinal center of the spout body.

2. A faucet as claimed in claim 6 wherein said emitter has an output by a generally conical cone of emission which is symmetrical about an axis and wherein the axis of the output is at an angle of about 20° relative to the axis of the field of view of the detector.

3. A faucet as claimed in claim 2 wherein the intersection of the cone of emission and the field of view of said detector forms a zone of effective detection which commences about an inch from said spout body planar surface.

4. A faucet as claimed in claim 3 wherein the zone of effective detection extends about six inches from said spout planar surface.

5. A faucet as claimed in claim 1 wherein said emitter is a light emitting diode and said detector is a phototransistor.

6. A faucet as claimed in claim 5 wherein said light-emitting diode has an output defined by a generally conical cone of emission symmetrical about an axis and said phototransistor has a field of view that is generally conical and symmetrical about an axis and wherein the axis of the cone of emission of said light-emitting diode and the axis of the field of view of said phototransistor are at a convergent angle relative to each other.

7. A faucet as claimed in claim 6 wherein said convergent angle is about 25°.

* * * * *